United States Patent [19]

Tetro et al.

[11] 4,326,680

[45] Apr. 27, 1982

[54] WEB CUTTER FOR A SURFACE WINDER

[75] Inventors: Richard S. Tetro; Paul E. Harmon, both of Fulton, N.Y.

[73] Assignee: The Black Clawson Company, Fulton, N.Y.

[21] Appl. No.: 165,303

[22] Filed: Jul. 2, 1980

[51] Int. Cl.[3] ..... B65H 19/20

[52] U.S. Cl. ..... 242/56 A

[58] Field of Search ..... 242/56 B, 56 R, 56 A, 242/65, 67.1 R

[56] References Cited

U.S. PATENT DOCUMENTS

| | | | |
|---|---|---|---|
| 3,365,141 | 1/1968 | Soloduk | 242/56 R |
| 3,871,595 | 3/1975 | Smolderer | 242/56 A |
| 3,889,892 | 6/1975 | Melead | 242/65 |
| 4,058,267 | 11/1977 | Schuttler | 242/56 A |
| 4,111,377 | 9/1978 | Tefro | 242/65 |

*Primary Examiner*—Edward J. McCarthy

*Attorney, Agent, or Firm*—Biebel, French & Nauman

[57] ABSTRACT

A web cutter for a surface winder provides a cutting blade which is moved into position adjacent the web and held stationary during cutting of the web. A web deflector is mounted for rotation about the axis of the drive drum on the opposite side of the web from the knife and when in the cutting position, deflects the web into the knife for severing the web. The device includes a guide shoe supported adjacent the knife for deflecting the severed edge of the web around the new core to be wound.

6 Claims, 6 Drawing Figures

WEB CUTTER FOR A SURFACE WINDER

BACKGROUND OF THE INVENTION

Cross Reference to Related Application

This application is related to application Ser. No. 165,301 filed on even date herewith.

Field of the Invention

The present invention relates to paper machinery, and more particularly to a cutting apparatus for severing the web in a continuous surface winder apparatus.

Prior Art

Surface winders are well-known in the prior art, as is exemplified by U.S. Pat. No. 2,703,683 (Evans et al). Likewise, web cut-off devices are known which are intended to permit continuous operation of the winder, as is exemplified by U.S. Pat. No. 3,794,255 (Harmon et al). Both of these patents are assigned to the assignee of the present invention.

As is illustrated by the latter of these patents, it is common to sever the web by accelerating the knife into the web which is supported on a surface in order to prevent the web from stretching or deflecting at the instant of contact. As is mentioned in greater detail in the above-identified related application, the introduction of new web materials and increasing operating line speeds has caused existing roll changer designs to produce some objectionable defects.

As a result, the cutting operation in the roll changing sequence is not carried out with the desired accuracy so that such things as fold back of the severed leading edge of the web which is wrapped around the new core occur. Likewise, many of the materials now being wound on such winding machines are resistant to tearing or cutting, particularly at high web speeds, such as in the order of 2,000 fpm, although such problems occur at even substantially lower speeds than this with certain materials.

A major problem in cutting elastic materials with prior art web cutting devices in which the blade is moved into the web is in trying to maintain a consistent cutting location relative to the distance the leading edge of the web must travel before it engages the new core. The more elastic the web material, the later in the cutting stroke the cut occurs due to the fact that the web behaves like a rubber band, and the knife cannot puncture it until enough resistance force builds up in the web. By this time, however, the web has now moved well past the desired cutting position, leaving a much longer unsupported severed end than is desired and which generally results in a fold back of the end as it wraps around the new core.

A further disadvantage associated with prior art web cutters for surface winders is that it is a common practice in the industry to utilize a core with either double sided adhesive tape applied to it or glue applied to the surface of the core in order to grip the free end of the web and wrap it around the core as it rotates. The use of such an adhesive core requires critical timing of the cutting blade action in order to prevent the adhesive from being removed from the core by contact with the web prior to its being cut. Also, in prior art devices at high speeds in particular, fold-back is a very common problem with adhesive cores.

SUMMARY OF THE INVENTION

The present invention overcomes the above described difficulties and disadvantages associated with the prior art surface winding apparatus by providing a knife blade which is positioned stationary next to the web, and deflecting the web into the knife blade so that the web is severed at an exact desired location due to web tension rather than movement of the blade, and which has the web deflection means mounted for rotation about the axis of the drive drum in such a manner that it is maintained on the opposite side of the web from the cutting blade so that the operation can be repeatedly performed to add subsequent new rolls without interrupting the winding operation.

Continuous winding machines of the surface winder or drum winder type include a frame, a driven drum supported in the frame for engaging the surface of a roll of web material being wound, a main support means on the frame for supporting the roll in driven position against the drum, and primary support means mounted on the frame for receiving and supporting a new core and moving the new core into a starting position in driven engagement against the surface of the drum.

The present invention provides an articulated cutting means mounted on the primary support means for movement therewith to a web cutting position adjacent one side of the web being wound on the roll and wherein it remains stationary during severing of the web. An articulated web deflector means is also provided mounted on the frame for rotation about the axis of the drum and disposed on the opposite side of the web from the cutting means for moving the web into engagement with the cutting means when in the web cutting position in order to sever the web. A guide means is utilized adjacent the cutting means for directing the severed web towards the new core so that it will be wound thereon. The cutting means includes a blade extending across the width of the web supported by a pair of laterally spaced blade support arms which are pivotally mounted to the primary support means for movement between a retracted position wherein the blade is disposed remote from the web and a cutting position wherein it is disposed adjacent a free running span of the web. The guide means includes a web guide shoe supported by the primary support arms for movement with the blade and positionable adjacent the new core when the arms are disposed in the cutting position for directing a severed edge of the web toward the new core so as to cause it to wind about the core without producing fold back.

The web deflector means includes a deflector member having a long straightedge extending across the width of the web for engaging the web and deflecting it into the path of the blade, and a pair of laterally spaced deflector support arms which support the deflector member for movement between a retracted position remote from the web and a web cutting position adjacent the cutting means in engagement with the web so that as the web deflector approaches the cutting position, it moves the web into the blade in order to sever the web. The deflector member support arms can be further articulated in order to fold the upper portion thereof in towards the surface of the drum after the cutting operation has occurred in order to permit the deflector member to be rotated about the drum with a minimum space requirement radially of the drum.

It is to be noted that the present invention not only prevents fold-back of the leading edge of the web on a new core being wound at high speeds, but also provides a system in which cores without adhesive tape or glue applied to their surface can be utilized, which is believed to be a material advantage over prior art devices.

DETAILED DESCRIPTION OF THE PREFERRED EMBODIMENT

Figure 1:
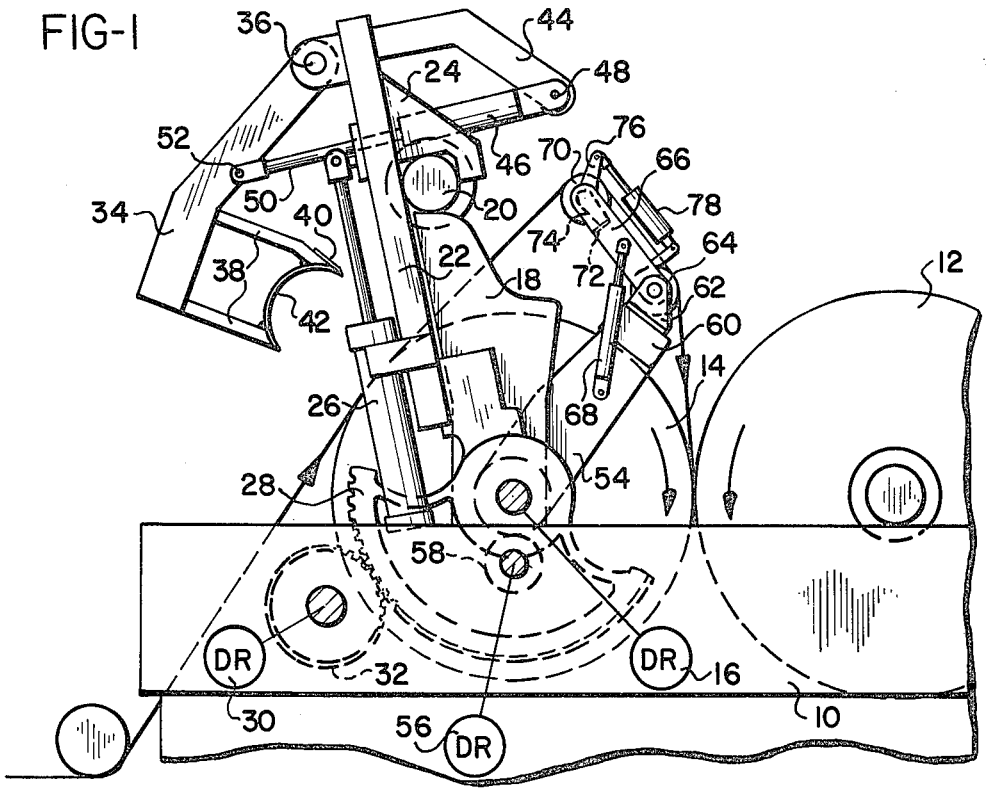
FIG. 1 is a side elevation view of the preferred embodiment of the present invention illustrating the cutting means and deflector means in their retracted positions.

As illustrated in FIG. 1, the cutting apparatus of the present invention is attached to a conventional surface winder which includes a base frame 10 with a generally horizontally extending extension which forms the main support means for supporting the almost completely wound roll of web material 12 which is in driven engagement with the drive drum 14. Drive drum 14 is supported in the main frame and is driven through its central axis by a drive 16 of conventional construction. A pair of camming members 18 (only one of which is shown) are disposed on opposite sides of the apparatus and secured to the base frame 10. There are used to provide initial support for the opposite ends of the new core 20 before its surface is brought into engagement with the surface of the drive drum 14.

A pair of primary support arms 22 are disposed on opposite sides of the drive drum 14 and mounted for rotation about its central axis. These primary support arms 22 are provided in conventional manner with hook shaped plates 24 supported in slideways on the primary support arms for movement radially towards and away from the drive drum 14 for capturing the new core 20 and holding it on the upper surface of the camming members 18. A hydraulic or pneumatic double acting cylinder 26 is supported by each of the primary support arms 22 and engages the hook shaped plates 24 for moving them along the slideways and maintaining them in position to hold the core 20 against the camming members 18 and also against the surface of the drive drum 14 as described below.

Each of the primary support arms 22 is supported for rotation about the axis of drum 14 and is provided with a segmented gear 28 which is driven by a drive means 30 through gear 32 for rotation of the primary support arms 22 about the drum during the sequence of operation as described below. The primary support arms are positioned outboard of each of the camming members 18.

The articulated cutting means includes a pair of laterally spaced arms 34 pivotally connected at their upper end portions by pins 36 to their respective primary support arm 22, and carry between them on a subframe structure 38 a cutting blade 40 which extends across the entire width of the web. Also supported on the subframe structure 38 is the guide means which is comprised of an arcuate sheet metal guide shoe 42 having a radius slightly larger than the new core 20 so that it can substantially encompass a portion of the new core and which extends across the entire width of the core for receiving and guiding the severed end of the web as described below. The cutting blade 40 is disposed closely adjacent the upper end portion of guide shoe 42 so that the severed edge of the web is guided onto the surface of the new core as soon as possible after it is cut.

Figure 2:
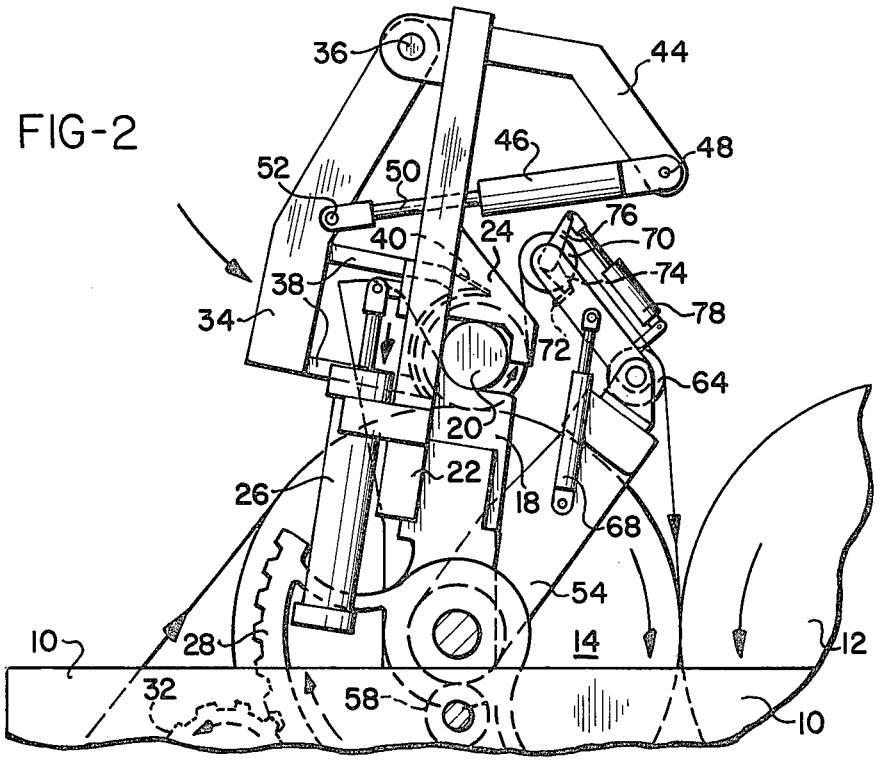
FIG. 2 is an enlarged partial view as in FIG. 1 with the cutting means disposed in the cutting position and the deflector means in a position just prior to being placed in the cutting position.

A pair of spaced rigid support brackets 44 are secured to the respective upper end portions of primary support arms 22 for supporting pneumatic or hydraulic double acting hydraulic cylinders 46. Cylinders 46 are pivotally secured by pins 48 to their respective brackets 44 and have their piston rods 50 pivotally connected by pins 52 to their respective arm 34 for causing pivotal movement of the arms 34 towards and away from the new core 20 for movement between a retracted position, as shown in FIG. 1, and a cutting position as shown in FIG. 2.

The articulated deflector means includes a pair of main support arms 54, one each disposed on opposite sides of the drum 14 and mounted for rotation about the drum axis and driven by the drive means 56 through gear 58. Main support arms 54 are disposed inboard of camming members 18 and are free to rotate completely around the drum 14 for the desired sequential movement described below.

A support beam 60 is secured to the outer end portions of and extends between, the main support arms 54 across the drive drum 14. Mounted to the support beam 60 at each end thereof are brackets 62 which together carry a cylindrical roll 64 extending across the width of the web.

A pair of secondary support arms 66 are pivotally mounted to brackets 62 on each side of the drum 14, and a further pair of hydraulic or pneumatic double acting cylinders 68 are pivotally connected at their ends between respective main and secondary support arms 54 and 66 for causing pivotal movement of the secondary support arms 66 relative to the main support arms 54 for reasons described below.

Figure 3:
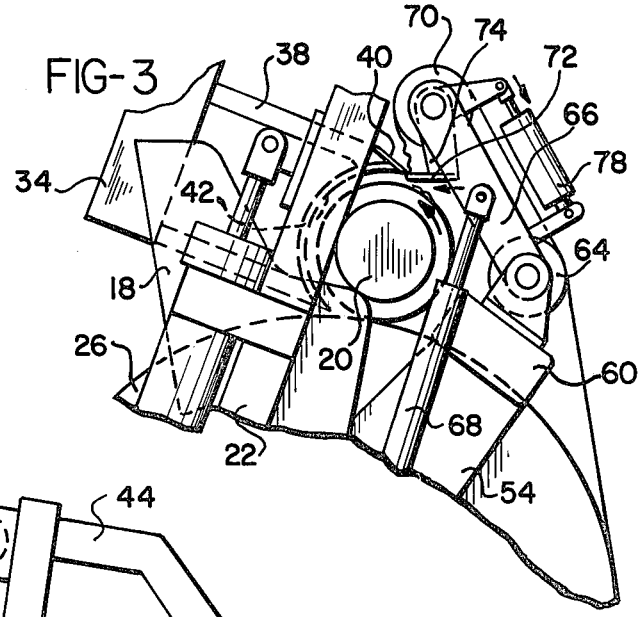
FIG. 3 is an enlarged partial view as in FIG. 2 with the deflector means now moved into the cutting position where the web is severed by the cutting blade.

Mounted between the outermost end portions of the secondary support arms 66 is a further cylindrical roll 70, commonly referred to as an enveloper roll, which extends across and engages the web when in the positions shown in FIGS. 1 through 3. A deflector member 72, which also extends across the width of the web, is carried at its ends on a pair of brackets 74 each pivotally mounted to a respective secondary support arm 66 and which in turn is secured to a respective lever arm 76. The outer ends of lever arms 76 are pivotally connected to a respective double acting pneumatic or hydraulic cylinder 78 which together are operative to cause the deflector member 72 to rotate toward and away from the web.

Figure 6:
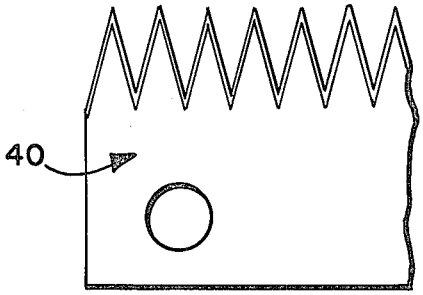
FIG. 6 is an enlarged partial view of the serrated cutting blade preferably used in the present invention.

Deflector member 72 is in the form of a bar having a straightedge which extends across and is brought into contact with the web. Deflector member 72 can have a sharp right angle edge or a radiused surface, if desired, since its purpose is to deflect the web into the blade and not to cut the web itself. The blade 40, on the other hand, is preferably of the serrated or saw tooth type, as illustrated in FIG. 6, which provides a much more uniform cut across the web than a straight blade does on materials which are relatively tear resistant such as plastic films and the like.

Referring now to the sequence of operation of the device, as shown in FIG. 1, the roll 12 is almost completely wound, and the web deflection means has been rotated clockwise to the position shown where a length of the web is raised from the surface of the drum 14 and is carried by the rollers 64 and 70 so that the winding of the roll 12 can continue.

The new core 20 is then brought down the camming surface of the camming members 18, as shown in FIG. 2, by rotation of the primary support arms 22 in the clockwise direction until the new core engages the surface of the drum and is brought up to the same peripheral speed. The articulated cutting means is then brought into position by contraction of cylinders 46 so that the guide shoe 42 is closely adjacent and surrounding a portion of the outer periphery of the core 20 with the blade 40 disposed adjacent the surface of the core and still remote from the web, as shown in FIG. 2.

After the blade 40 is in position, the main support arms 54 are rotated slightly counterclockwise in order to bring the enveloper roll 70 over the blade 40, as illustrated in FIG. 2, so that the web, although not yet in contact with the edge of the blade 40, will be extending in a plane which is at an acute angle to the upper surface of the blade to assist the blade in its cutting action. The deflector member is then actuated through the contraction of cylinders 78 to cause the web to be moved into the blade 40, which will result in immediate severing of the web, as illustrated in FIG. 3. As soon as the web is severed, the leading edge will immediately be guided along the inner surface of the guide shoe 42 between the guide shoe and the surface of the new core 20 to a place closely adjacent the surface of the drum 14 in order to reduce the possibility of fold back of the leading edge of the web prior to its being enveloped by itself on subsequent rotations of the new core 20.

Figure 4:
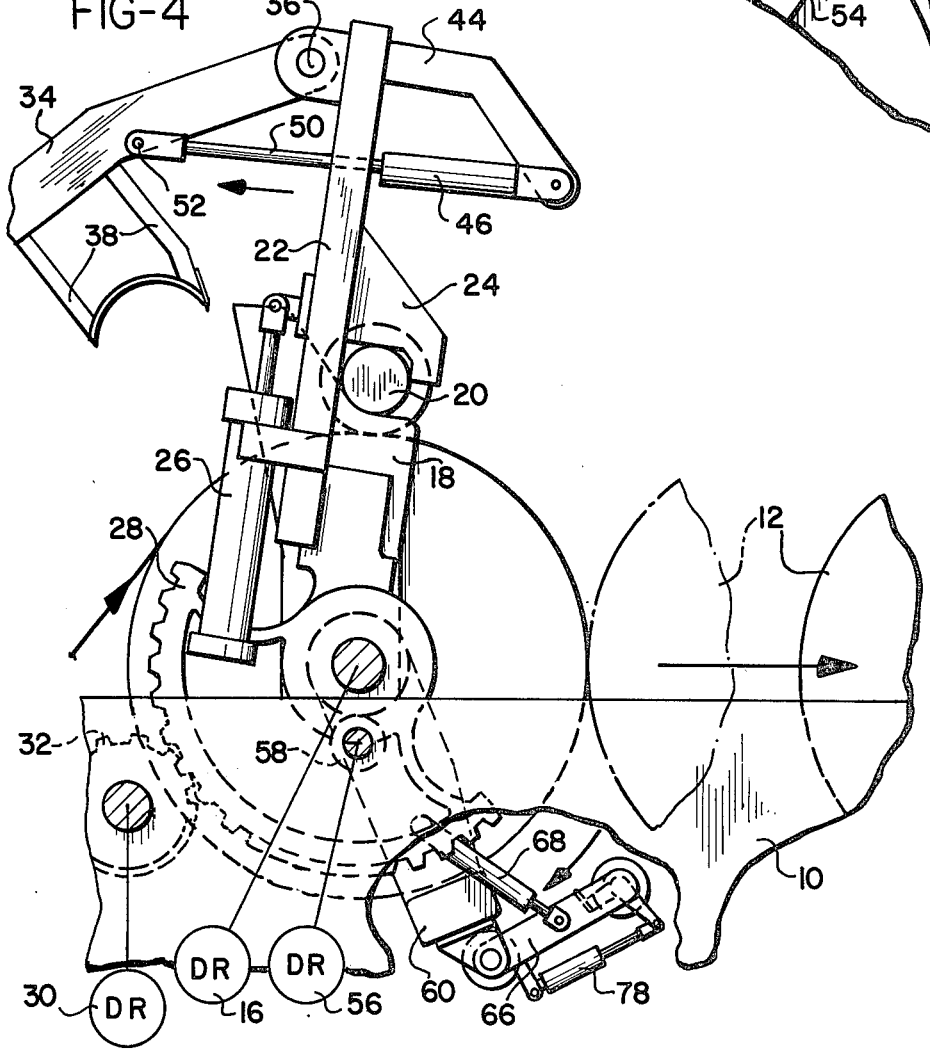
FIG. 4 is a view as in FIG. 2 with the cutting means retracted and the deflector means rotating downwardly about the axis of the drive drum.

After the cut has occurred, the main support arms 54 are rotated clockwise. In addition, in order to minimize the extension of the web deflection means radially outward from the drum, the secondary support arms 66 are retracted inwards by cylinders 68 to present a minimum extension radially of the drum for maximum clearance as the web deflection means rotates under the drum as illustrated in FIG. 4. The web cutting means is then retracted by extension of cylinders 46 to remove the guide shoe 42 and blade 40 from the surface of the new core 20 by rotation of brackets 34.

Figure 5:
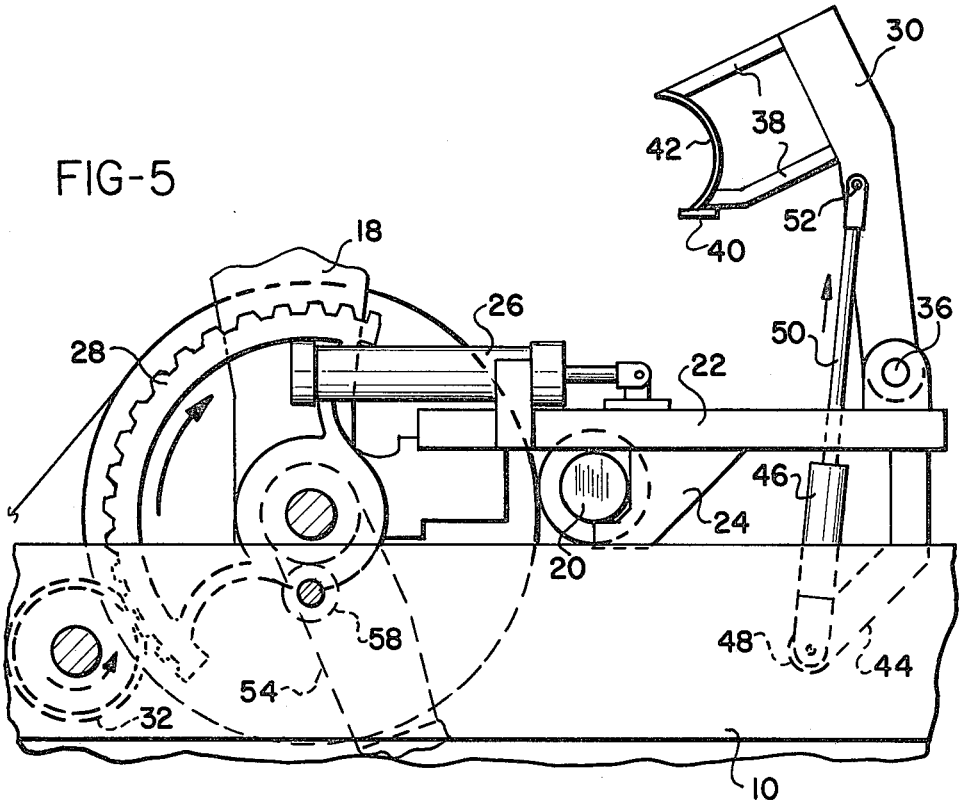
FIG. 5 is a view as in FIG. 2 with the cutting means and primary support arms being rotated clockwise to place the new core upon which the web is being wound, in a position for continuing winding thereof.

The primary support arms 22 are then rotated clockwise to the position illustrated in FIG. 5 where the new core will eventually be supported by the main support means which are extensions of the base frame 10, as was the previously wound roll 12. After a substantial amount of web has been wound around the new core in the position of FIG. 5, the cylinders 26 are extended to release the new core from the brackets 24, and the primary support arms are then rotated counterclockwise to the position illustrated in FIG. 1 where they are ready to receive another new core to continue the process.

Although the foregoing illustrates the preferred embodiment of the present invention, other variations are possible. All such variations as would be obvious to one skilled in this art are intended to be included within the scope of the invention as defined by the following claims.

What is claimed is:

1. In a continuous winding machine of the surface winder type including a frame, a driven drum supported in said frame for engaging the surface of a roll of web material being wound, main support means on said frame for supporting said roll in driven position against said drum, and primary support means mounted on said frame for receiving and supporting a new core and moving said core into starting position in driven engagement against the surface of said drum, the improvement comprising:

an articulated cutting means mounted on said primary support means for movement therewith and movable to a web cutting position adjacent one side of but out of engagement with the web being wound on said roll and wherein it remains stationary during severing of the web;

an articulated web deflector means mounted on said frame for rotation about the axis of said drum and disposed on an opposite side of said web from said cutting means, for moving said web into engagment with said cutting means when in said web cutting position to sever said web; and guide means adjacent said cutting means for directing said severed web towards said new core so that it will be wound thereon.

2. A roll changer as defined in claim 1 wherein said cutting means includes:

a cutting blade extending across the width of said web;

a pair of laterally spaced blade support arms for supporting said blade and which are pivotally mounted to said primary support means for movement between a retracted position wherein said blade is disposed remote from said web, and a cutting position wherein said blade is disposed adjacent but out of engagement with a free running span of said web; and said guide means includes a web guide shoe supported by said support arms for movement with said blade and positionable adjacent said new core when said arms are disposed in said cutting position, for directing a severed edge of said web toward said new core to cause it to wind thereabout.

3. A roll changer as defined in claim 1 wherein said deflector means includes:

a deflector member having a long straightedge extending the width of said web for engaging said web; and a pair of laterally spaced deflector member support arms to which said deflector member is secured and which are movable between a retracted position remote from said web and a web cutting position adjacent said cutting means in engagement with said web so that as said deflector member approaches said cutting position, it moves said web into said blade to thereby sever said web.

4. A roll changer as defined in claim 1 including:

an enveloper roll; and means rotatably mounting said enveloper roll on the side of said web opposite said cutting means for moving said enveloper roll between a retracted position disengaged from said web and an active position wherein said enveloper roll causes said web to envelop a portion of the periphery of said new core upstream of said cutting means.

5. In a continuous winding machine of the surface winder type including a frame, a driven drum supported in said frame for engaging the surface of a roll of web material being wound, main support means on said frame for supporting said roll in driven position against said drum, and primary support means mounted on said frame for receiving and supporting a new core and moving said core into starting position in driven engagement against the surface of said drum, the improvement comprising:

a cutting means mounted on said winding machine for movement between a retracted position away from the web and a cutting position adjacent to but out of engagement with one side of the web;

a web deflector means mounted on said winding machine for movement on an opposite side of the web from said cutting means, for engaging said web and moving it into said cutting means when in said web cutting position to sever said web; and guide means mounted to said winding machine for movement with said cutting means into a position adjacent said cutting means when in said web cutting position, for directing a severed end of said web towards said new core so that it will be wound thereabout.

6. A roll changer as defined in claim 1 or 5 wherein said cutting means is diposed on the new core side of the web.

* * * * *